US008540549B2

(12) United States Patent
Drew

(10) Patent No.: US 8,540,549 B2
(45) Date of Patent: Sep. 24, 2013

(54) BRASSIERES

(75) Inventor: Lorna Drew, High Wycombe (GB)

(73) Assignee: Lorna Drew Ltd. (GB)

( * ) Notice: Subject to any disclaimer, the term of this patent is extended or adjusted under 35 U.S.C. 154(b) by 143 days.

(21) Appl. No.: 12/893,911

(22) Filed: Sep. 29, 2010

(65) Prior Publication Data

US 2012/0077414 A1 Mar. 29, 2012

(51) Int. Cl.
*A41C 3/00* (2006.01)

(52) U.S. Cl.
USPC ..... 450/36; 450/86

(58) Field of Classification Search
USPC ..... 450/86, 36, 37, 1; 2/326, 327, 338, 2/336, 105, 106, 73, 79
See application file for complete search history.

(56) References Cited

U.S. PATENT DOCUMENTS

| | | | | |
|---|---|---|---|---|
| 2,317,664 A | | 4/1943 | Becker | 2/42 |
| 4,390,024 A | | 6/1983 | Williams | 128/460 |
| 4,878,879 A | * | 11/1989 | Kunstadter | 450/36 |
| 5,180,326 A | * | 1/1993 | Williams | 450/91 |
| 5,485,658 A | * | 1/1996 | Fildan | 24/614 |
| 5,624,296 A | * | 4/1997 | Weber-Unger | 450/36 |
| D410,411 S | * | 6/1999 | Fildan | D11/210 |
| D412,462 S | * | 8/1999 | Fildan | D11/208 |
| 6,656,013 B1 | * | 12/2003 | Wang | 450/86 |

* cited by examiner

*Primary Examiner* — Gloria Hale
(74) *Attorney, Agent, or Firm* — Hayes Soloway P.C.

(57) ABSTRACT

A brassiere having at least one breast supporting cup where at least one breast-supporting cup has a frontal opening to expose the breast is disclosed. The breast-supporting cup includes a panel/flap that covers the opening and a part of which is releasably attachable to the shoulder strap of the brassiere when closing the opening so that on release the opening may be uncovered. The panel/flap is releasably attachable to the shoulder strap by a clasp on the shoulder strap that is movable up and down the shoulder strap to a selected position and has a clamping part so that it may be clamped at the selected position, thereby providing adjustment of the breast-supporting cup. The clasp incorporates a co-operative engagement device thereon for the releasable attachment of the panel/flap.

11 Claims, 2 Drawing Sheets

BRASSIERES

FIELD OF THE INVENTION

The present invention concerns improvements in and relating to brassieres of the type where the cups are openable such as in maternity and nursing brassieres or medical brassieres.

BACKGROUND TO THE INVENTION

Maternity, nursing and some pre/post-operative surgical/medical brassieres generally share the feature of having a central panel in one or both of the brassiere cups that is in the form of a flap that may be peeled back at an edge to expose the wearer's corresponding breast. For maternity and nursing brassieres this facilitates suckling of the infant and for surgical/medical brassieres this facilitates treatment of the breast whether preceding or following biopsy, partial mastectomy or other procedure.

In maternity brassieres simple clips have been used for many years to detachably secure the apex/leading edge of the panel closed. These clips are generally of hook and eye type with a hook at the apex of the panel to engage in an eye on the bra's shoulder strap. A problem common to the majority of such brassieres is that they do not have flexibility to accommodate for the substantial changes in breast size and shape that occur in lactating mothers or as a result of surgery or other breast tissue damage/trauma. In mothers who breastfeed their babies the breast expands substantially when full with milk, swelling to even go up a whole cup size, and then shrinking again once the mother has fed her baby. In essence half of the time these mothers are wearing the wrong cup size of bra—either the bra is too big or too small, since there is no way to adjust the size of the cups.

Proposals have been made in the past to try to address this problem, including multi-point fastening arrangements as set out in US patents numbers U.S. Pat. No. 2,317,664 and U.S. Pat. No. 4,390,024. Each of these patents proposes use of several eyes arranged in a line up the shoulder strap of the brassiere to be selectively engaged by a hook at the apex of the central panel/flap. The choice of eye gives the user the ability to raise or lower the point at which the apex of the flap is secured to the strap and hence adjusts for enlargement or diminution of the breast. The perimeter of the cups in U.S. Pat. No. 4,390,024 is defined by wide stretchable bands to give greater elastic accommodation for the flux in breast size.

It is an objective of the present invention to provide an improved brassiere of the type where the cups are openable/adjustable and which substantially alleviates the problems of fluctuating breast size. It is a further object to provide a brassiere which gives the user control over adjustment for fluctuating breast size independently of attaching the opening flap/panel of the brassiere cup to the brassiere shoulder strap. It is a further object to provide a brassiere which gives the user a relatively fine control over adjustment. The improved brassiere is to have an adjust-to-fit component to raise the bra cup up and down the bra strap and which may provide a better quality, continually supportive, and more comfortable maternity bra to the market.

SUMMARY OF THE INVENTION

According to a first aspect of the present invention there is provided a brassiere comprising one or a pair of breast supporting cups and of the type where at least one of the breast-supporting cups has a frontal opening to expose the breast, the breast-supporting cup comprising a panel/flap that covers the opening and a part of which is releasably attachable to the shoulder strap of the brassiere to support the breast-supporting cup and so that on release the opening may be uncovered, characterized in that the means by which the panel/flap is releasably attachable to the shoulder strap comprises a clasp on the shoulder strap that is movable up and down the shoulder strap to a selected position and having a clamping part so that it may be clamped at the selected position, thereby providing adjustment of the breast-supporting cup, the clasp incorporating co-operative engagement means thereon for the releasable attachment of the panel/flap.

Preferably the shoulder strap has a plurality of transverse ribs thereon each serving as an abutment on the shoulder strap for the clamping part of the clasp to stop against.

Suitably the co-operative engagement means on the clasp comprises a hook and the cup panel/flap has a tab with an aperture to engage with the hook.

The brassieres allows the user to raise the bra cup up and down the bra strap and provides a better quality, continually supportive, and more comfortable maternity bra. Moreover it gives the user control over adjustment for fluctuating breast size independently of attaching the opening flap/panel of the brassiere cup to the brassiere shoulder strap and the user can have a much finer control over adjustment than is afforded by the prior art.

The brassiere may not only be used by nursing mothers. For medical brassieres the adjustment of the present invention is useful since after any breast surgery the straps can be adjusted to allow for any post surgery swelling and the cups can be adjusted individually. Therefore, if only one breast is operated on both breasts can be perfectly supported even if they are of different sizes due to removal of tissue or due to swelling.

BRIEF DESCRIPTION OF THE DRAWINGS

A preferred embodiment of the present invention will now be more particularly described, by way of example only, with reference to the accompanying drawings, in which.

DESCRIPTION OF THE PREFERRED EMBODIMENT

Figure 1:
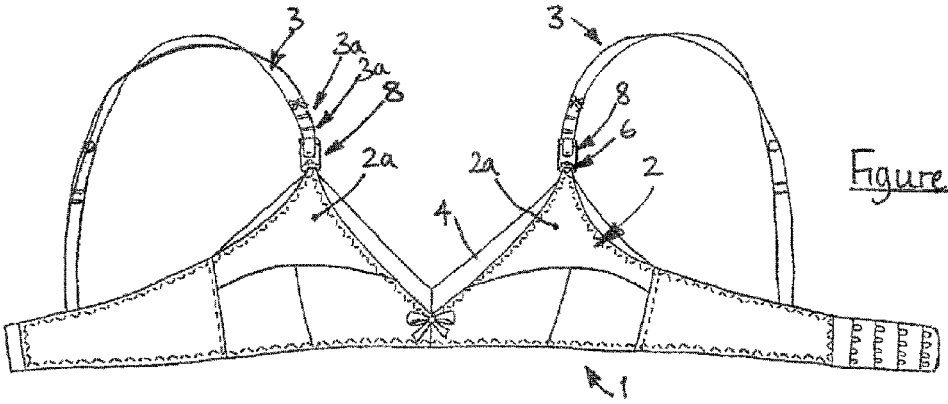
FIG. 1 is a front elevation view of a brassiere embodying the invention.
Figure 2:
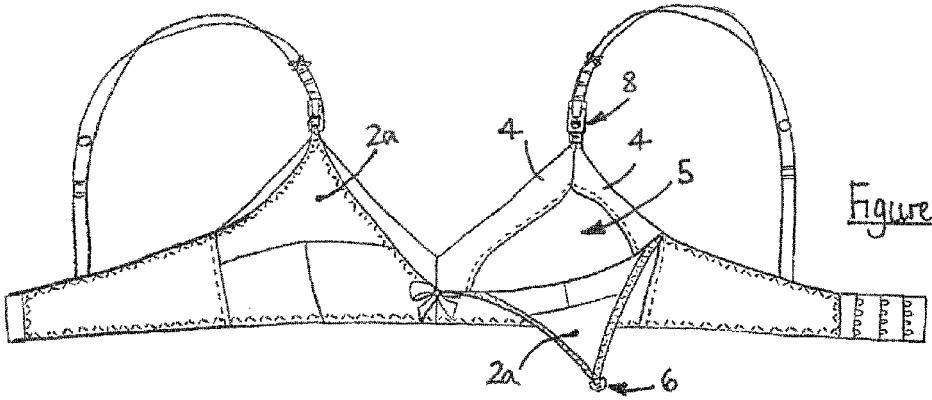
FIG. 2 is a corresponding view showing the panel/flap of the left cup of the brassiere hanging down for exposure of the breast.
Figure 3:
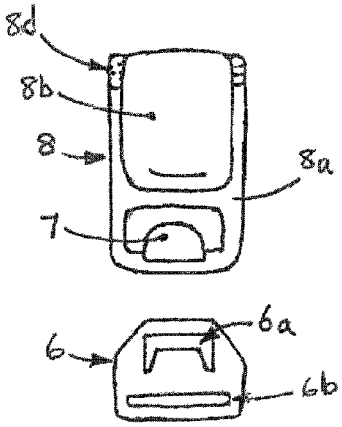
FIG. 3 is a front elevation view of the clasp showing the clasp in the closed state and, below the clasp, the co-operating eye tab that fits on the apex of the flap/panel.

Referring to FIGS. 1 and 2, these show a maternity brassiere 1 with its characteristic fold-down central panels/flaps 2*a* at the front of the cups 2.

The panels 2*a* have an approximately triangular form and when they are in the closed state the apex of each triangle is uppermost and detachably fastens to the lower end of the front length of a respective one of the shoulder straps 3 of the brassiere 1. The perimeter of each cup 2 is defined by bands 4 of a material that suitably is an elasticated fabric that can adjust somewhat to breast size fluctuation and the bands 4 of each cup form an aperture/opening 5 at the centre that exposes the underlying wearer's breast for breast-feeding. The central cup openings 5 are covered over by the central panel/flap 2*a* until access is needed for breast-feeding at which point the panel 2*a* apex is detached from the shoulder strap 3 and the flap is folded down as shown on the right of FIG. 2.

The releasable attachment of the central panel/flap 2*a* to the shoulder strap 3 has a unique arrangement. The apex of each central panel/flap 2*a* carries a tab 6, suitably of moulded plastics or of metal, which incorporates an eyehole 6*a*. A second aperture 6*b* in the tab 6 receives a length of the fabric of the panel/flap 2*a* passing through it and looped and stitched to secure the tab 6 on the panel/flap 2*a*. The eyehole 6*a* of the tab 6 is designed to co-operatively engage in use with a corresponding hook formation 7 that is formed on the lower front end of a clasp structure 8 that is mounted on the brassiere strap 3.

The clasp structure 8 is adapted to have one of the brassiere's shoulder straps 3 passing through it and to be moved up and down the shoulder strap 3 with the clasp in its opened state and secured to the strap 3 at a selected location by closing of the clasp 8. The clasp structure 8 is suitably of moulded plastics or of metal and has a body part 8*a* that fits on and is movable up and down the shoulder strap 3 and a clamp part 8*b* with teeth 8*d*, the clamp part 8*b* being pivotally mounted 8*c* to the body part 8*a* to pivot between open and closed states to bite into and lock on the strap 3 when the chosen position on the strap 3 has been selected.

The teeth 8*d* of the clasp structure 8 effectively close down on the strap 3 behind one of a number of ribs 3*a* that are provided on the strap 3. The ribs 3*a* are in the region of the strap 3 where the apex of the flap is to attach and the ribs 3*a* extend transversely of the longitudinal axis of the strap 3 and can be many and at very close-spaced intervals down the strap 3 to allow for a fine and extensive degree of control over the position of attachment and hence over cup-size adjustment.

The ribs 3*a* of the bra shoulder strap 3 may be formed by insertion of short lengths of wire in the strap or may be formed by stitching, folding or addition of other material to that area of the strap 3*a*. Although illustrated in the side elevation views as bulging to both front and rear of the strap 3, each rib 3*a* might suitably be provided bulging only forwardly/ in the direction facing the clamping part 8*b* of the clasp 3 so that the rear of the strap 3 is smooth, aiding upward and downward adjustment. Notably, the ribs 3*a* are generally of such small scale that they do not affect the wearer's comfort.

Figure 4:
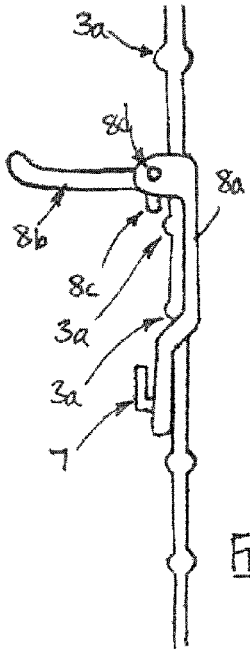
FIG. 4 is a side elevation view of the clasp in part-opened state, the clasp being shown installed upon the lower front end of the bra's shoulder strap
Figure 5:
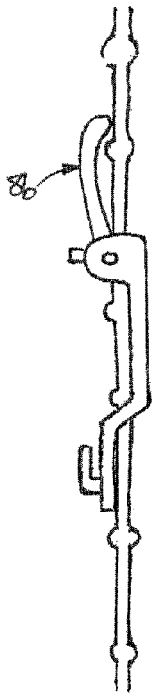
FIG. 5 is a corresponding view of the clasp in fully opened state and shifted one 'rung' down the shoulder strap.
Figure 6:
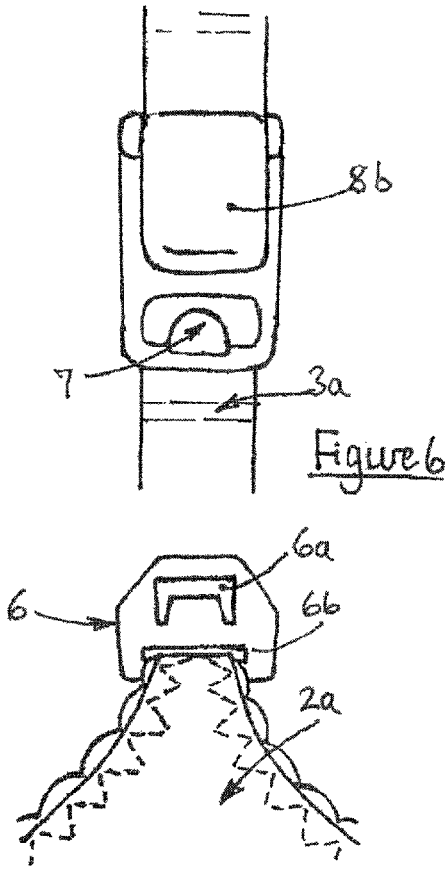
FIG. 6 is a front elevation view of the shut state of the clasp installed on the shoulder strap and, below the clasp, the co-operating eye tab is shown installed on the apex of the flap/panel being brought up to the hook on the clasp to be hooked in place.
Figure 7:
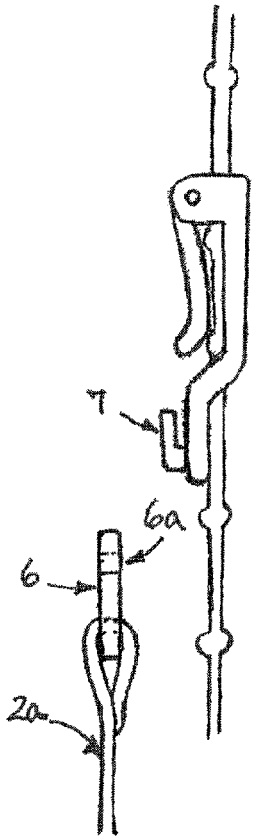
FIG. 7 is a side elevation view of the FIG. 6 arrangement.
Figure 8:
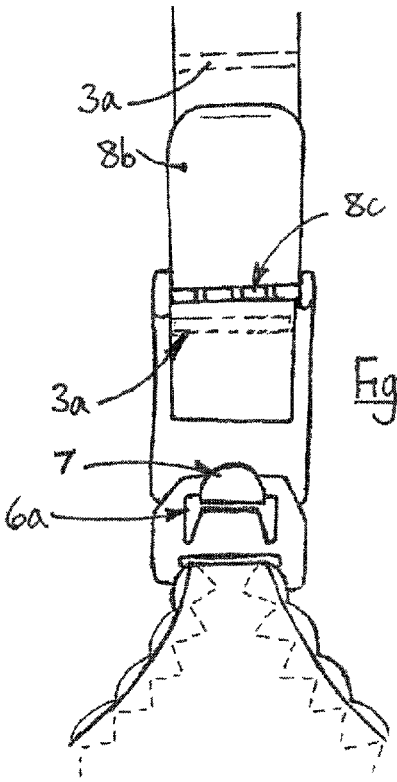
FIG. 8 is a front elevation view of the clasp installed on the shoulder strap and with the co-operating eye tab hooked onto the hook of the clasp, the clasp being open for upward or downward adjustment of the clasp's position on the shoulder strap.
Figure 9:
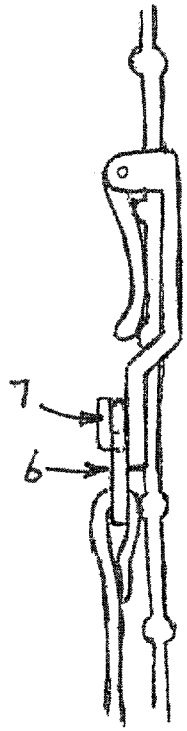
FIG. 9 is a side elevation view of the FIG. 8 arrangement but with the clasp shut to lock it at its selected position on the strap.

Referring to FIGS. 4 to 9, the clasp structure 8 may be adjusted to the desired position by the wearer independently of the step of hooking attachment of the central panel 2*a* and thus may be done before, during or after the central panel 2*a* is hooked to it. The clasp 8 installed on the bra shoulder strap 3 with the clamping part 8*b* raised, as in FIGS. 4 and 5, is able to be moved up and down to then be clamped at any chosen position. The step of hooking the eyelet 6*a* of the tab 6 at the apex of central panel 2*a* to the hook 7 on the clasp 8 is shown in FIGS. 7 to 9. For this the state of the clasp clamping part 8*a* does not matter and it may be in its raised/opened state as in FIG. 8 or lowered/closed state as in FIG. 9 while hooking to suit the wearer's preference in how they fit and adjust the brassiere cup.

The invention claimed is:

1. A brassiere comprising at least one breast supporting cup, the breast-supporting cup having a frontal opening to expose the breast, the breast-supporting cup comprising a panel/flap covering the opening and which is releasably attachable to the shoulder strap of the brassiere when closing said opening and when said panel/flap is released said opening is uncovered, wherein said releasably attachable shoulder strap comprises a clasp mounted on said shoulder strap wherein said shoulder strap extends through said clasp and said clasp is movable up and down said shoulder strap to any one of a number of predetermined positions; said clasp having a body part and a clamping part, said clamping part being movably mounted to said body part to move between opened and closed clamping states, wherein the clasp is clampable at a selected predetermined position, thereby providing adjustment of the breast-supporting cup to adjust for a change in size of a wearer's breast, the clasp incorporating a co-operative engagement feature thereon for the releasable attachment of the panel/flap on said shoulder strap.

2. The brassiere as claimed in claim 1, wherein the shoulder strap has a plurality of transverse ribs thereon each serving as an abutment on the shoulder strap for the clamping part of the clasp to stop against.

3. The brassiere as claimed in claim 1, wherein the co-operative engagement feature on the clasp comprises a hook and the panel/flap of the cup has a tab with an aperture to engage with the hook.

4. The brassiere as claimed in claim 3, wherein the tab has an aperture that receives material of the panel/flap therethrough to secure the tab to the panel/flap.

5. The brassiere as claimed in claim 2, wherein the ribs incorporate plastic or metal wire.

6. The brassiere as claimed in claim 2, wherein said shoulder strap has a front length, the front length having a lower end, the ribs being provided on the front length of the strap at the lower end thereof.

7. A brassiere comprising at least one breast supporting cup, the breast-supporting cup having a frontal opening to expose the breast, the breast-supporting cup comprising a panel/flap covering the opening and which is releasably attachable to the shoulder strap of the brassiere when closing said opening and when said panel/flap is released said opening is uncovered, wherein said releasably attachable shoulder strap comprises a clasp mounted on said shoulder strap wherein said shoulder strap extends through said clasp and said clasp is movable up and down said shoulder strap to any one of a number of predetermined positions; said clasp having a body part and a clamping part, said clamping part being movably mounted to said body part to move between opened and closed clamping states, wherein the clasp is clampable at a selected predetermined position, thereby providing adjustment of the breast-supporting cup to adjust for a change in size of a wearer's breast, the clasp incorporating a co-operative engagement feature thereon for the releasable attachment of the panel/flap on said shoulder strap, wherein the shoulder strap has a plurality of transverse ribs thereon each serving as an abutment on the shoulder strap for the clamping part of the clasp to stop against.

8. The brassiere as claimed in claim 7, wherein the ribs incorporate plastic or metal wire.

9. The brassiere as claimed in claim 7, wherein said shoulder strap has a front length, the front length having a lower end, the ribs being provided on the front length of the strap at the lower end thereof.

10. A brassiere comprising at least one breast supporting cup, the breast-supporting cup having a frontal opening to expose the breast, the breast-supporting cup comprising a panel/flap covering the opening and which is releasably attachable to the shoulder strap of the brassiere when closing said opening and when said panel/flap is released said opening is uncovered, wherein said releasably attachable shoulder strap comprises a clasp mounted on said shoulder strap wherein said shoulder strap extends through said clasp and said clasp is movable up and down said shoulder strap to any one of a number of predetermined positions; said clasp having a body part and a clamping part, said clamping part being movably mounted to said body part to move between opened and closed clamping states, wherein the clasp is clampable at a selected predetermined position, thereby providing adjustment of the breast-supporting cup to adjust for a change in size of a wearer's breast, the clasp incorporating a co-operative engagement feature thereon for the releasable attachment of the panel/flap on said shoulder strap, wherein the co-operative engagement feature on the clasp comprises a hook and the panel/flap of the cup has a tab with an aperture to engage with the hook.

11. The brassiere as claimed in claim 10, wherein the tab has an aperture that receives material of the panel/flap therethrough to secure the tab to the panel/flap.

* * * * *